US011826812B2

(12) United States Patent
Breen et al.

(10) Patent No.: US 11,826,812 B2
(45) **Date of Patent: *Nov. 28, 2023**

(54) TIGHT SPACE PILOT

(71) Applicant: STANDARD LIFTERS, INC., Grand Rapids, MI (US)

(72) Inventors: Scott M. Breen, Ada, MI (US); Joel T. Pyper, Holland, MI (US)

(73) Assignee: STANDARD LIFTERS, INC., Grand Rapids, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/983,035

(22) Filed: Nov. 8, 2022

(65) Prior Publication Data

US 2023/0058550 A1 Feb. 23, 2023

Related U.S. Application Data

(63) Continuation of application No. 17/063,743, filed on Oct. 6, 2020, now Pat. No. 11,541,445.

(60) Provisional application No. 62/911,596, filed on Oct. 7, 2019.

(51) Int. Cl.
*B21D 37/08* (2006.01)
*B21D 22/02* (2006.01)

(52) U.S. Cl.
CPC ..... *B21D 37/08* (2013.01); *B21D 22/02* (2013.01)

(58) Field of Classification Search
CPC .... B21D 37/12; B21D 43/003; B21D 43/023; B21D 45/02; B21D 22/02; B21J 13/10; B21J 13/14
See application file for complete search history.

(56) References Cited

U.S. PATENT DOCUMENTS

| | | | |
|---|---|---|---|
| 2,168,377 | A | 8/1939 | Wales |
| 3,335,627 | A | 8/1967 | Smelts |
| 3,336,627 | A | 8/1967 | Nemoede et al. |
| 3,620,113 | A | 11/1971 | Gargrave |
| 3,848,452 | A | 11/1974 | Gargrave |
| 3,938,794 | A | 2/1976 | Stevens et al. |
| 3,998,369 | A | 12/1976 | Grosjean et al. |
| 4,118,968 | A | 10/1978 | Ames |
| 4,282,736 | A | 8/1981 | Mashburn |

(Continued)

FOREIGN PATENT DOCUMENTS

| | | | | |
|---|---|---|---|---|
| CN | 108262406 A | * | 7/2018 | ..... B21J 15/12 |
| CN | 108838316 | | 11/2018 | |

(Continued)

OTHER PUBLICATIONS

Standard Lifters, Inc., "Pilot Assembly," sales brochure, Grand Rapids, Michigan USA (Oct. 2011).

(Continued)

*Primary Examiner* — Debra M Sullivan
*Assistant Examiner* — Matthew Stephens
(74) *Attorney, Agent, or Firm* — PRICE HENEVELD LLP

(57) ABSTRACT

A tight space pilot, tight space pilot assembly, and related method includes a tight space pilot that can be installed into a die without fasteners, fastener apertures, or added blocks for mounting. The tight space pilot assembly includes ejectors that are retained by the pilot and a retaining ring that holds the tight space pilot in place in a die member.

20 Claims, 6 Drawing Sheets

(56) References Cited

U.S. PATENT DOCUMENTS

| | | | | |
|---|---|---|---|---|
| 4,326,402 | A | 4/1982 | Wallis | |
| 4,342,214 | A | 8/1982 | Neuendorf | |
| 4,424,639 | A | 1/1984 | Richardson | |
| 4,457,196 | A | 7/1984 | Cady | |
| 4,516,449 | A | 5/1985 | Boyette | |
| 4,644,836 | A | 2/1987 | Wepner et al. | |
| 4,646,599 | A | 3/1987 | Benedict | |
| 4,839,952 | A | 6/1989 | Yokoyama | |
| 4,884,484 | A | 12/1989 | Bakermans et al. | |
| 4,916,931 | A | 4/1990 | Kaeseler | |
| 4,945,749 | A | 8/1990 | Walker et al. | |
| 4,993,295 | A | 2/1991 | Dacey, Jr. | |
| 5,359,914 | A | 11/1994 | Brown | |
| 5,722,280 | A | 3/1998 | Bodnar | |
| 5,860,315 | A | 1/1999 | Sawdon | |
| 6,470,546 | B1 | 10/2002 | Bonny et al. | |
| 7,581,475 | B2 | 9/2009 | Moellering | |
| 7,694,399 | B2 | 4/2010 | Sawdon et al. | |
| 8,844,335 | B2 | 9/2014 | Pyper et al. | |
| 8,950,233 | B2 | 2/2015 | Pyper et al. | |
| 8,955,364 | B2 * | 2/2015 | Breen | B21D 28/34 72/344 |
| 9,067,253 | B2 | 6/2015 | Pyper et al. | |
| 9,138,799 | B2 * | 9/2015 | Breen | B21D 43/06 72/344 |
| 9,289,815 | B2 | 3/2016 | Breen et al. | |
| 9,375,777 | B2 * | 6/2016 | Breen | B21D 45/02 72/344 |
| 9,381,560 | B2 | 7/2016 | Pyper et al. | |
| 9,469,043 | B2 | 10/2016 | Sugizaki et al. | |
| 9,737,923 | B2 * | 8/2017 | Breen | B21D 37/08 72/344 |
| 9,895,740 | B2 | 2/2018 | Breen et al. | |
| 10,406,585 | B2 | 9/2019 | Pyper et al. | |
| 10,730,099 | B2 | 8/2020 | Breen et al. | |
| 11,541,445 | B2 * | 1/2023 | Breen | B21D 37/08 72/344 |
| 2005/0241360 | A1 | 11/2005 | Miller et al. | |
| 2006/0193937 | A1 | 8/2006 | Gakovic | |
| 2009/0044671 | A1 | 2/2009 | Greenleaf | |
| 2009/0193865 | A1 | 8/2009 | Pyper et al. | |
| 2013/0167612 | A1 | 7/2013 | Breen et al. | |
| 2013/0255350 | A1 | 10/2013 | Schneider et al. | |

FOREIGN PATENT DOCUMENTS

| | | |
|---|---|---|
| JP | 56084130 | 7/1981 |
| JP | 56122634 | 9/1981 |
| JP | 57100825 | 6/1982 |
| JP | 06142788 | 5/1994 |
| KR | 1020010069897 | 7/2001 |
| KR | 1020060104028 | 10/2006 |
| KR | 100766072 | 10/2007 |
| RU | 1822811 | 6/1993 |
| SU | 389870 | 11/1934 |
| SU | 1061886 | 12/1983 |

OTHER PUBLICATIONS

Standard Lifters, Inc., "Pilot Sleeve," sales brochure, Grand Rapids, Michigan USA (Jan. 2012).

Fibro Inc., "Pilot Units to Daimler Standard," catalog, p. E72, Rockford, Illinois USA (date unknown).

Dayton Progress Corporation, "Regular Pilots," pp. 9, 11, 13, Dayton, Ohio USA (date unknown).

Ajacs Die Sales Corporation, "Pilot Retainer," sales brochure, Grand Rapids, Michigan USA (date unknown).

Misumi Corporation, "Pilot Punches," catalog, pp. 202, 220, 228, 234, 242, 946, 948, Schaumburg, Illinois USA (date unknown).

Modern Die Systems Inc., "Die Accessories," sales brochure, Ellwood, Indiana USA (date unknown).

* cited by examiner

TIGHT SPACE PILOT

CROSS REFERENCE TO RELATED APPLICATION

The present application is a continuation of and claims priority under 35 U.S.C. § 120 to commonly assigned U.S. Pat. No. 11,541,445, issued Jan. 3, 2023, entitled TIGHT SPACE PILOT, which Applicant hereby claims the priority benefits under the provisions of 35 U.S.C. § 119, basing said claim of priority on related U.S. Provisional Application No. 62/911,596 filed Oct. 7, 2019, which is incorporated in its entirety herein by reference.

FIELD OF THE INVENTION

The present invention relates to metal forming dies, and particularly to a tight space pilot and associated methods.

BACKGROUND OF THE INVENTION

Metal forming dies, such as stamping dies and the like are well known in the art. Progressive metal forming dies are unique, very sophisticated mechanisms which have multiple stations or progressions that are aligned longitudinally, and are designed to perform a specified operation at each station in a predetermined sequence to create a finished metal part. Progressive stamping dies are capable of forming complex metal parts at very high speeds, so as to minimize manufacturing costs.

Heretofore, the dies used in metal forming presses have typically been individually designed, one of a kind assemblies for a particular part, with each of the various components being handcrafted and custom mounted or fitted in an associated die set, which is in turn positioned in a stamping press. Not only are the punches and other forming tools in the die set individually designed and constructed, but the other parts of the die set, such as stock lifters, guides, end caps and keepers, cam returns, etc., are also custom designed and individually installed in the die set. Current die making processes require careful machining, precision holes and recesses in the die set for mounting the individual components, such that the same are quite labor intensive, and require substantial lead time to make, test and set up in a stamping press. Consequently, such metal forming dies are very expensive to design, manufacture and repair or modify.

The metal part can be accurately located in an individual working station by means of a previously formed hole on the part being placed over a pilot, which registers the part before the work is performed. The pilot is mounted in one of the die members as the part is presented to the pilot. The pilot usually has a shaped end that makes it easier to enter the formed hole on the part. Much of engagement into locating the hole in the part is dependent upon the work being performed in the tool. The part may need to be lifted prior to or after work is performed. The part is usually located on the pilot in the working position and potentially the lifted position as well. These pilots can be purchased as standard components or home-made by a shop.

The shaped end of the pilot that enters the formed hole in the metal part comes in many shapes, such as a short taper, long taper, acute-angle, bullet nose, parabolic point, spherical, and chamfered.

While such prior pilot assemblies have been successful, they are rather large, expensive, and time-consuming to construct and install in an associated die set, particularly when there is not much room for additional components in the die set, such that further improvements and enhancements to the same, as well as metal forming dies generally, would be clearly advantageous and are disclosed herein.

SUMMARY OF THE INVENTION

One aspect of the present invention is a metal forming die having at least two mutually converging and diverging die members between which a stock piece is shifted longitudinally with an improved pilot assembly. The pilot assembly has a pilot body with a first end portion oriented away from the stock piece, with a first diameter, and an oppositely disposed second end portion oriented toward the stock piece, with a second diameter that is larger than the first diameter. The difference in diameters defines a shoulder on the exterior surface of the pilot body. The pilot body includes a generally tapered portion that extends from the second end portion of the pilot body toward the tip of the pilot body, with the tip having a diameter that is smaller than the second diameter of the second end portion. The pilot body also has a retaining ring groove located on the first end portion. The pilot assembly includes at least one ejector pin body. The ejector pin body has a first end portion oriented away from the stock piece, with a first diameter, an oppositely disposed second end portion, with a second diameter, oriented toward the stock piece, and a medial portion, with a third diameter. The third diameter is larger than the first diameter and the second diameter. The ejector pin body has a first shoulder at the intersection of the first diameter and the third diameter. The ejector pin body also has a second shoulder at the intersection of the second diameter and third diameter. The pilot assembly includes a spring member surrounding at least a portion of the first end portion of the ejector pin body. The spring member has a first end portion oriented away from the stock piece and a second end portion oriented toward the stock piece. The second end portion of the spring member will contact the first shoulder of the ejector pin body. The pilot assembly also includes a retaining ring that is coupled to the retaining ring groove and the pilot body. The second shoulder on the ejector pin body will abut the first shoulder on the guide pin body to positively limit travel of the ejector pin body when the spring member expands.

Another aspect of the present invention is a pilot assembly for metal forming die in which stock is formed into at least one part. The pilot assembly includes a pilot body having a first end portion, with a first diameter, oriented away from the stock, and an oppositely disposed second end portion, with a second diameter, oriented toward the stock. The second diameter is larger than the first diameter to define a first shoulder therebetween. The pilot body includes a generally tapered portion, extending from the second diameter, that tapers to the tip of the pilot body. The pilot body also has a retaining ring groove located on an exterior surface of the first end portion. The pilot assembly includes at least one ejector pin body having a first end portion, with a first diameter, oriented away from the stock. The ejector pin body also has a second end portion, with a second diameter, oriented toward the stock. The ejector pin body includes a medial portion with a third diameter that is larger than the first diameter and the second diameter, that is disposed between the first end portion and the second end portion. The ejector pin body includes a first shoulder at the intersection of the first diameter and third diameter, and a second shoulder at the intersection of the second diameter and third diameter. The pilot assembly includes a spring member surrounding at least a portion of the first end portion of the ejector pin body. The spring member has a first end portion oriented away from the stock, and a second end portion oriented toward the stock. The second end portion will contact the first shoulder of the ejector pin body. The pilot assembly includes a retaining ring coupled to the retaining ring groove in the pilot body. The second shoulder of the ejector pin body will contact the first shoulder of the guide pin body to positively limit travel of the ejector pin body as the spring member expands.

Yet another aspect of the present invention is a pilot assembly for engaging a hole in a stock. The pilot assembly includes a pilot body having a first end portion, with a first diameter, oriented away from the stock. The pilot body has an oppositely disposed second end portion, having a second diameter that is larger than the first diameter, and is oriented toward the stock. The pilot body has a shoulder formed at the intersection of the first diameter and the second diameter. The pilot body also has a generally tapered portion that extends from the second diameter toward the tip of the pilot. The tip includes a terminal end portion that is smaller than the hole in the stock. The pilot body also has a retaining ring groove that is located on the first end portion. The pilot assembly includes at least one ejector pin body having a first end portion oriented away from the stock with a first diameter. The ejector pin body also has an oppositely disposed second end portion with a second diameter that is oriented toward the stock. The ejector pin body has a medial portion with a third diameter that is larger than the first diameter and the second diameter, disposed between the first end portion and the second end portion. The ejector pin body has a first shoulder at the intersection of the first diameter and third diameter, and a second shoulder at the intersection of the second diameter and third diameter. The pilot assembly includes a spring member surrounding at least a portion of the first end portion of the ejector pin body. The spring member has a first end portion oriented away from the stock and a second end portion oriented toward the stock, the second end portion contacting the first shoulder of the ejector pin body. The pilot assembly also includes a retaining ring coupled to the retaining ring groove in the pilot body.

These and other advantages of the invention will be further understood and appreciated by those skilled in the art by reference to the following written specification, claims, and appended drawings.

DETAILED DESCRIPTION OF THE PREFERRED EMBODIMENTS

For purposes of description herein, the terms "upper," "lower," "right," "left," "rear," "front," "vertical," "horizontal," and derivatives thereof shall relate to the invention as oriented in the attached drawings. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
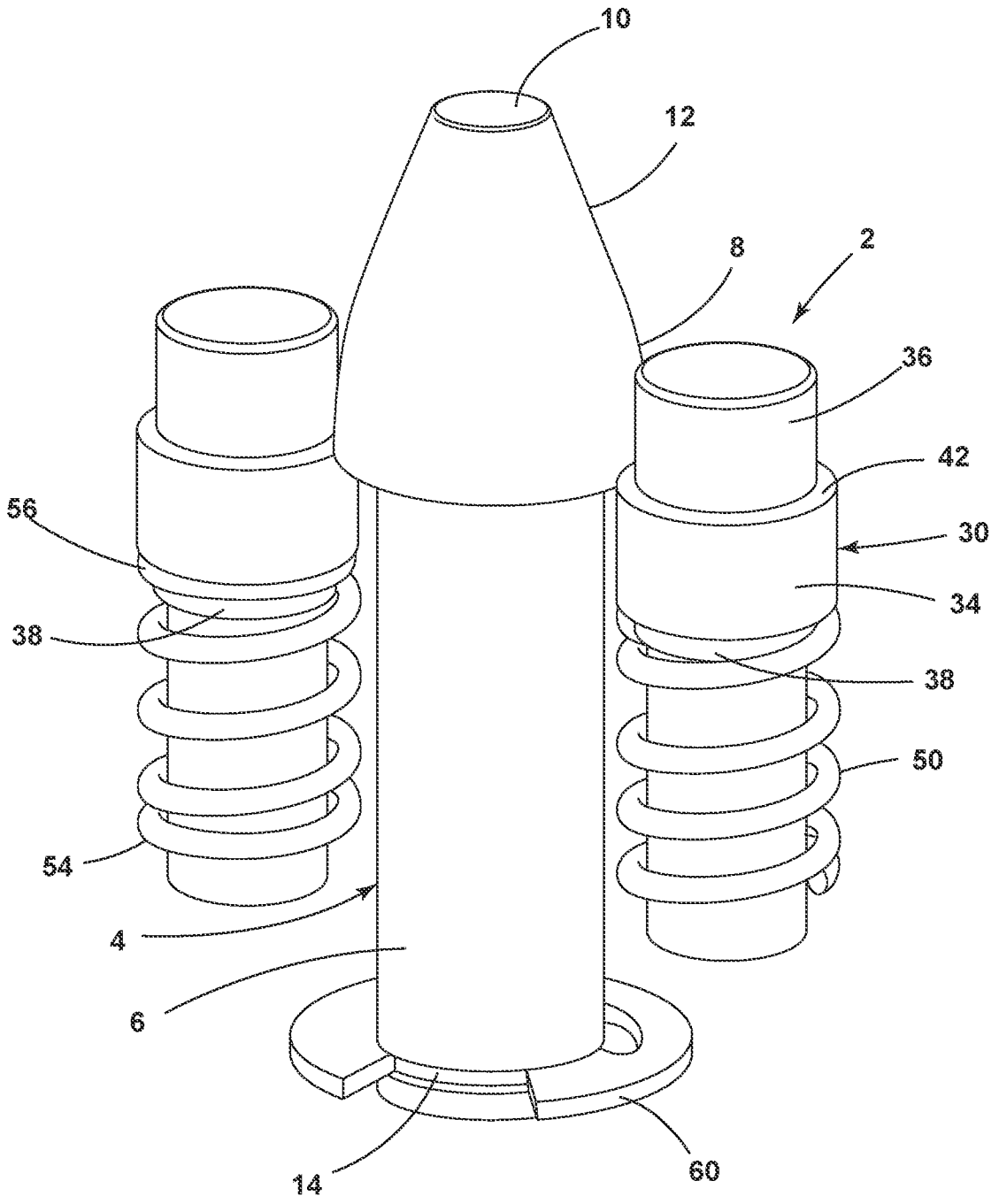
FIG. 1 is a front perspective view of a pilot assembly embodying an aspect of the present invention.
Figure 2:
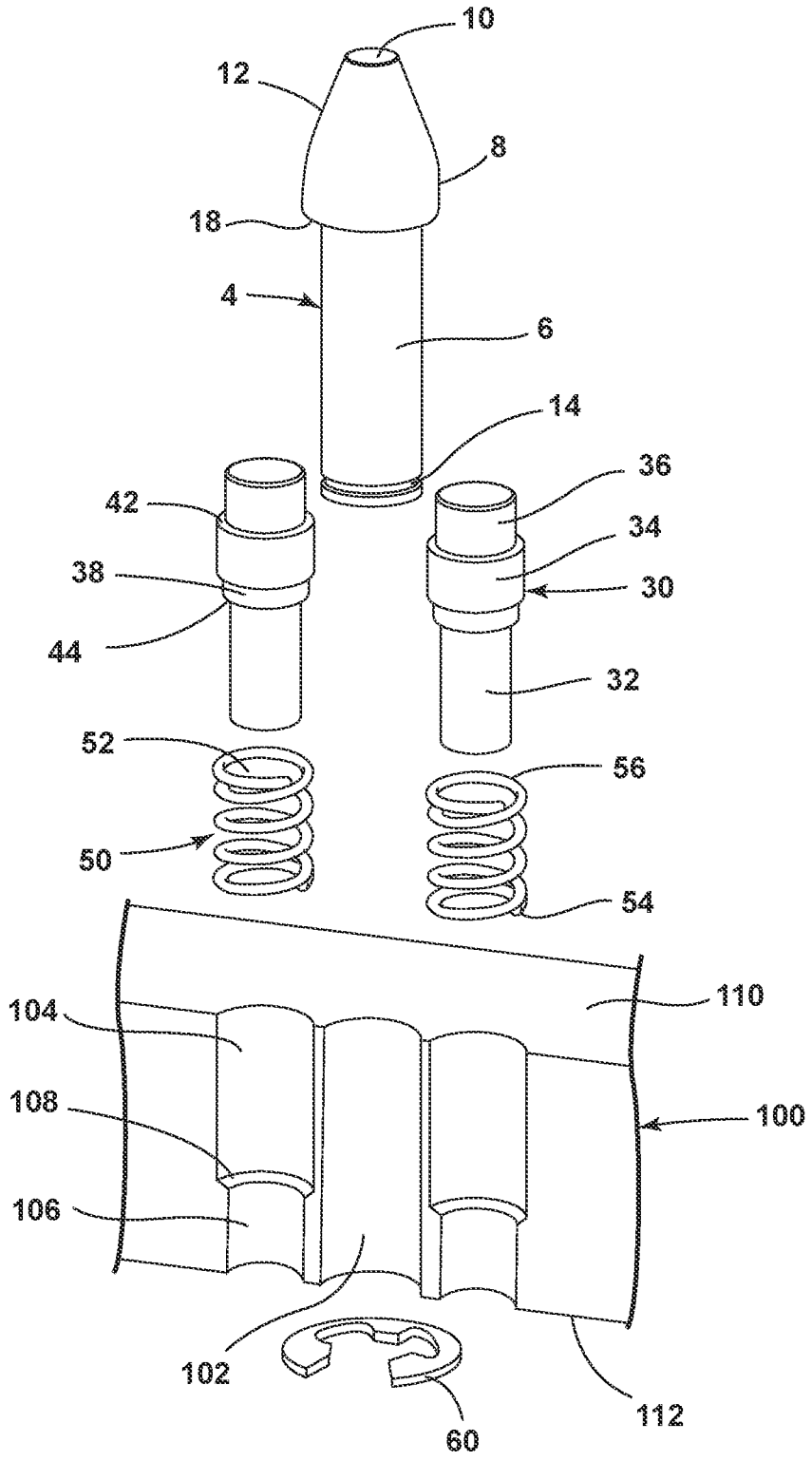
FIG. 2 is an exploded perspective view of the pilot assembly shown in FIG. 1, along with a partial cross-sectional view of a die member.
Figure 3:
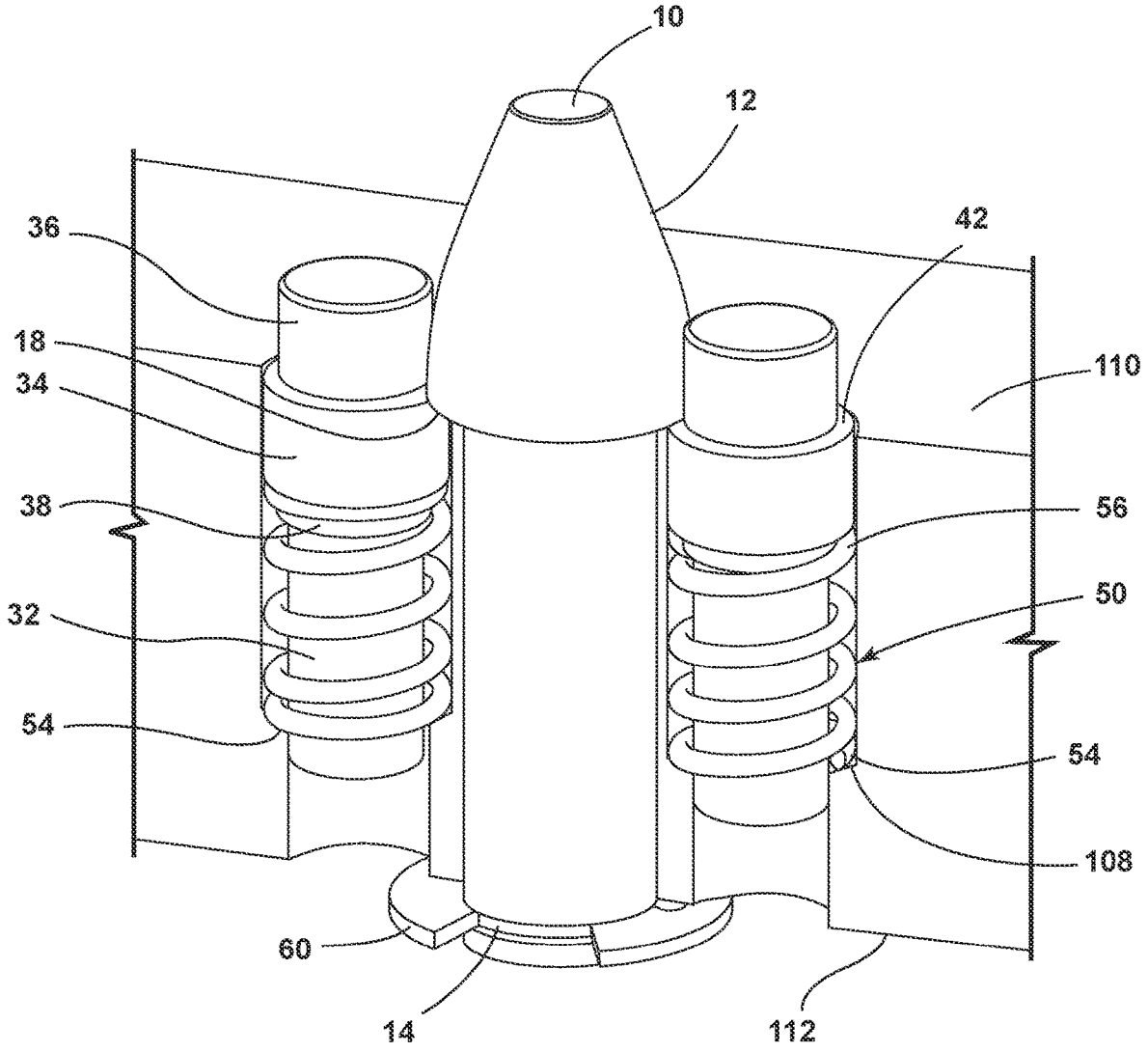
FIG. 3 is a front perspective view of the pilot assembly shown in FIG. 1 installed in a die member.
Figure 5:
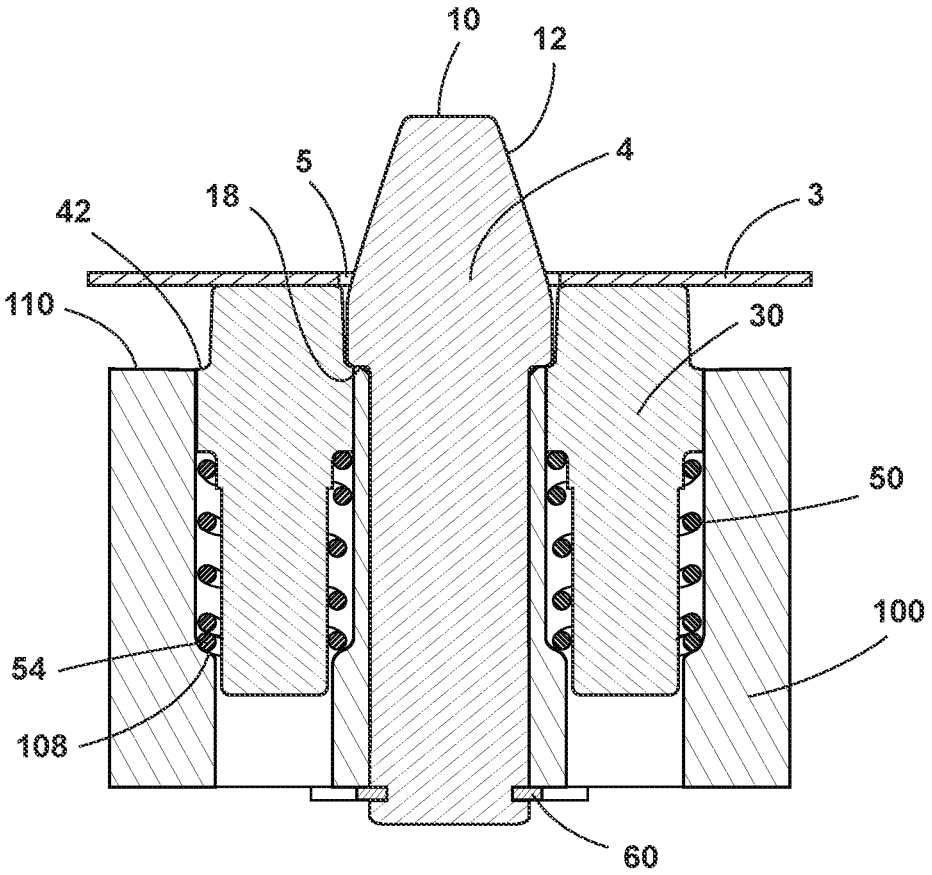
FIG. 5 is a cross-sectional view of the pilot assembly and die member shown in FIG. 3 with the spring member expanded.
Figure 8:
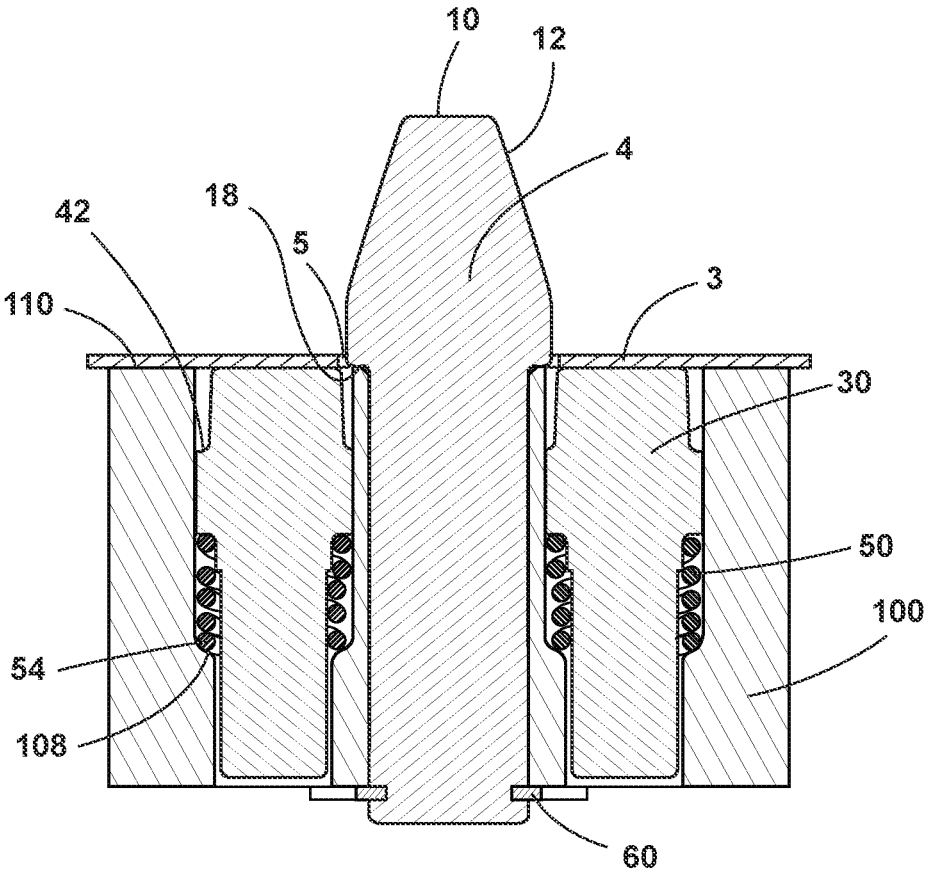
FIG. 8 is a cross-sectional view of the pilot assembly and die member shown in FIG. 5 with the spring member compressed and the stock piece is adjacent to the top surface of the die member.

The reference numeral 2 (FIGS. 1-3, 5) generally designates a pilot assembly embodying an aspect of the present invention. As shown in FIG. 1, the pilot assembly 2 includes a pilot body 4 with one or more ejector pin bodies 30. A spring member 50 is used with each ejector pin body 30 to permit the ejector pin bodies 30 to lift upward to disengage a piece of stock strip 3 from engagement with the pilot body 4. A retaining ring 60 is used to couple the pilot body 4 to the die member 100, as shown in FIGS. 3, 5, and 8.

Figure 6:
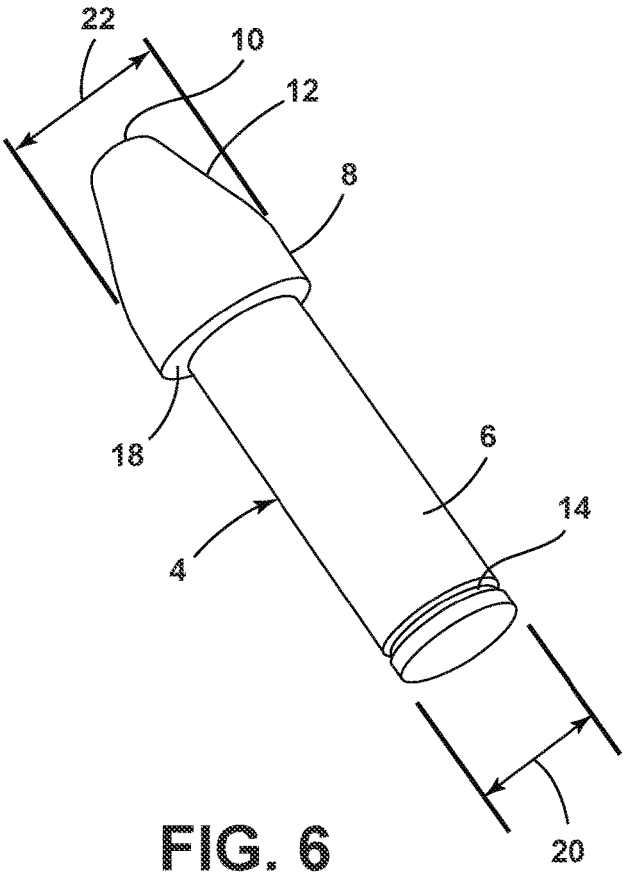
FIG. 6 is a front perspective view of the pilot body of the pilot assembly shown in FIG. 1.
Figure 7:
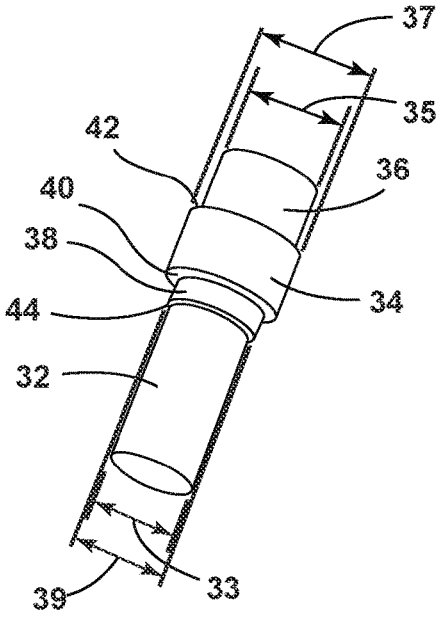
FIG. 7 is a front perspective view of the ejector pin body of the pilot assembly shown in FIG. 1.

The pilot body 4 includes a first end portion 6 that is oriented away from the stock strip 3. The pilot body 4 has a second end portion 8 that is oriented toward the stock strip 3. As illustrated in FIG. 6, the first end portion 6 has a first diameter 20 and the second end portion 8 has a second diameter 22, that is larger than the first diameter 20. The difference in the diameters 20, 22 results in shoulder 18 on the exterior surface of pilot body 4. The pilot body 4 includes a tapered section 12 that tapers toward the tip 10. The width of the tip 10 is smaller than the hole 5 in stock strip 3. Pilot body 4 includes a retaining ring groove 14 on the first end portion 6.

The ejector pin body 30 has a first end 32 that is oriented away from the stock strip 3. The ejector pin body 30 has a second end 36 that is oriented toward the stock strip 3. A medial section 34 is located between the first end portion 32 and the second end portion 36. The first end portion 32 has a first diameter 33. The second end portion 36 has a second diameter 35, while the medial portion 34 has a third diameter 37. The third diameter 37 is greater than the first diameter 33 creating a first shoulder 40 on ejector pin body 30. The third diameter 37 is also larger than the second diameter 35 creating a second shoulder 42 on ejector pin body 30. The ejector pin body 30 may optionally include a wider portion 38 on the first end portion 32 that creates a third shoulder 44. When the wider portion 38 is included on the ejector pin body 30, the first shoulder 40 is formed between the fourth diameter 39 of the wider portion 38 and the third diameter 37 of the medial portion 34.

Spring member 50 includes a hollow interior 52. As illustrated in FIGS. 1, 3, 5, and 8, the hollow interior 52 is over a portion of the first end portion 32 of ejector pin body 30. The spring member 50 includes a first end 54 oriented away from the stock strip 3 and second end 56 oriented toward the stock strip 3. When the first end portion 32 of the ejector pin body 30 has a wider portion 38, the wider portion 38 may be sized to closely fit and/or engage the hollow interior 52 of spring member 50. The spring member 50 can be any conventional spring, including, but not limited to, metal springs.

A retaining ring 60 is used to attach the pilot body 4 to the die member 100, as illustrated in FIGS. 3, 5, and 8. The retaining ring 60 couples to the retaining ring groove 14 on pilot body 4. In the illustrated embodiments, the retaining ring 60 is a E-shaped retaining ring, although alternative rings that can be coupled to the retaining ring groove 14 of pilot body 4 can be used.

Figure 4:
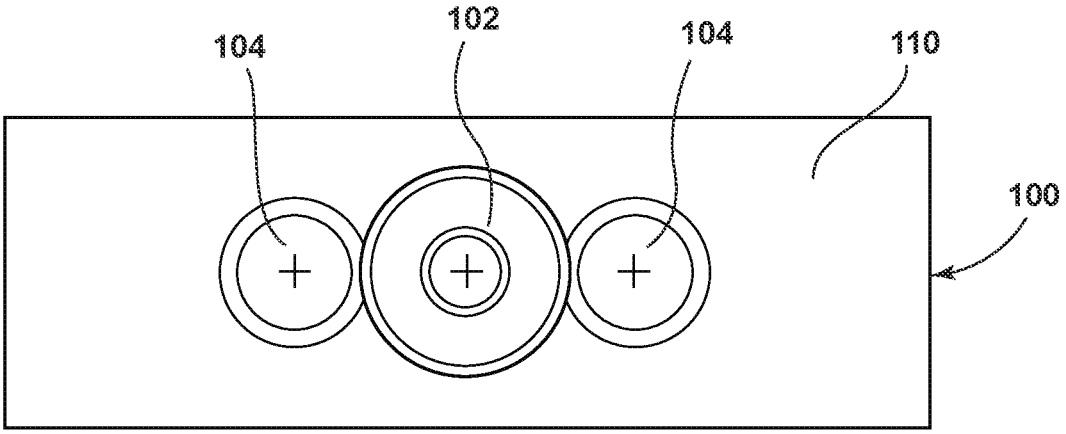
FIG. 4 is a top view of the apertures of the die member.

The die member 100 includes a pilot aperture 102 and ejector pin aperture 104, as illustrated in FIG. 4. The ejector pin aperture 104 includes a narrow portion 106, as illustrated in FIG. 2, that creates an internal shoulder 108 in the ejector pin aperture 104. When the pilot assembly 2 is installed in die member 100, the ejector pin bodies 30 are received in the ejector pin aperture 104 of the die member 100. The first end 54 of the spring member 50 will engage the internal shoulder 108 of the ejector pin aperture 104, as illustrated in FIGS. 3, 5, and 8. The second end 56 of the spring member 50 will engage the first shoulder 40 of the ejector pin body 30. The pilot body 4 is inserted into the pilot aperture 102. The retaining ring 60 is inserted into the retaining ring groove 14 in pilot body 4 and will abut the lower surface 112 of die member 100. As illustrated in FIGS. 3, 5, and 8, the shoulder 18 of pilot body 4 will contact the second shoulder 42 of the ejector pin body 30 when the spring member 50 is not compressed. As illustrated in FIG. 8, when the spring member 50 is compressed, the stock strip 3 can engage the top surface 110 of the die member 100. In that arrangement, the second shoulder 42 of the ejector pin body 30 no longer engages the shoulder 18 of the pilot body 4.

When die members converge, the stock strip 3 will be pushed down the tapered section 12 of the pilot body 4 as the ejector pin bodies 30 move toward the lower surface 112 of die member 100. The spring member 50 will compress toward the internal shoulder 108 of the ejector pin aperture 104 in die member 100. Once the die members diverge, the spring member 50 is permitted to expand, moving the second shoulder 42 of the ejector pin body 30 toward the shoulder 18 of pilot body 4. This raises the stock strip 3 from the top surface 110 of die member 100. When the stock strip 3 is raised, it disengages from the tapered portion 12 of the pilot body 4, as shown in FIG. 5. The hole 5 in stock strip 3 can be closely engaged and even contact the exterior surface of the pilot body 4 when the stock strip 3 is fully engaged on the tapered section 12 and/or second end portion 8. The hole 5 in stock strip 3 can have the same diameter as the second diameter 22 of the pilot body 4.

While the illustrated embodiments show the use of two ejector pin bodies 30 with a single pilot body 4, any number of ejector pin bodies 30 can be used and the spacing of the ejector pin bodies 30 can be varied. For example, a single ejector pin body 30 can be used. Moreover, in the illustrated embodiment, while the two ejector pin bodies 30 are shown as spaced on opposite sides of the pilot body 4, the ejector pin bodies 30 do not have to be disposed opposite one another. Moreover, three or more ejector in bodies 30 can be used. As can be seen, the shoulder 18 of the pilot body 4 can be generally flush with the top surface 110 of die member 100, as illustrated in the drawings. In that arrangement, the pilot body 4 contacts both the top surface 110 of die member 100 and through use of the retaining ring 60 indirectly the bottom surface 112 of die member 100.

The pilot body 4 and the ejector pin body 30 can each be made from a single piece of material. For example, the pilot body 4 can be machined from a single piece of metal. Similarly, the ejector pin body 30 can be machined from a single piece of metal. The metal can be coated and/or have another surface treatment. The pilot body 4 and ejector pin body 30 can alternatively be made from multiple pieces that are coupled together.

In the foregoing description, it will be readily appreciated by those skilled in the art that modifications may be made to the invention without departing from the concepts disclosed herein. Such modifications are to be considered as included in the following claims, unless these claims by their language expressly state otherwise.

It will be understood by one having ordinary skill in the art that construction of the present disclosure and other components is not limited to any specific material. Other exemplary embodiments of the disclosure disclosed herein may be formed from a wide variety of materials, unless described otherwise herein.

For purposes of this disclosure, the term "coupled" or "operably coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

For purposes of this disclosure, the term "connected" or "operably connected" (in all of its forms, connect, connecting, connected, etc.) generally means that one component functions with respect to another component, even if there are other components located between the first and second component, and the term "operable" defines a functional relationship between components.

It is also important to note that the construction and arrangement of the elements of the present disclosure as shown in the exemplary embodiments is illustrative only. Although only a few embodiments of the present innovations have been described in detail in this disclosure, those skilled in the art who review this disclosure will readily appreciate that, unless otherwise described, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating positions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

The invention is claimed as follows:

1. A metal forming die having at least two mutually converging and diverging die members with a stock piece working area configured to receive a stock piece, the improvements of a pilot assembly, comprising:

a pilot body having a first end portion oriented away from the stock piece working area, with a first diameter, and an oppositely disposed second end portion oriented toward the stock piece working area, with a second diameter that is larger than said first diameter to define a first shoulder therebetween, at least a portion of said shoulder being in contact with at least a portion of the upper surface of one of said die members and including:

a tip having a diameter that is smaller than said second diameter; and a retaining ring groove located on said first end portion, at least one ejector pin body, positioned adjacent to said pilot body, having a first end portion oriented away from the stock piece working area with a first diameter, an oppositely disposed second end portion, with a second diameter oriented toward the stock piece working area, and a medial portion with a third diameter that is larger than said first diameter and said second diameter disposed between said first end portion and said second end portion, and including:

a first shoulder at the intersection of said first diameter and said third diameter;

a second shoulder at the intersection of said second diameter and said third diameter; and a spring member surrounding at least a portion of said first end portion of said ejector pin body, said spring member having a first end portion oriented away from said stock piece working area and a second end portion oriented toward said stock piece working area, at least a portion of said second end portion contacting at least a portion of said first shoulder on said ejector pin body;

a retainer ring coupled to said retaining ring groove in said pilot body, at least a portion of said retainer ring being in contact with at least a portion of the lower surface of said one die member; and wherein at least a portion of said second shoulder on said ejector pin body abuts at least a portion of said first shoulder on said pilot body to positively limit travel of said ejector pin body when said spring member expands.

2. The metal forming die as set forth in claim 1, wherein said first end portion of said at least one ejector pin body includes a wider section with a width that is greater than said first diameter of said first end portion of said ejector pin body.

3. The metal forming die as set forth in claim 1, including a pair of ejector pin bodies disposed on opposite sides of said pilot body.

4. The metal forming die as set forth in claim 1, wherein said retaining ring is an E-style ring.

5. The metal forming die as set forth in claim 1, including a pilot aperture in a die member, wherein said retaining ring abuts a lower surface of said die member.

6. The metal forming die as set forth in claim 5, including at least one ejector pin aperture, located adjacent to said pilot aperture, with an internal shoulder formed at the intersection of a larger diameter and a smaller diameter of said pilot aperture.

7. The metal forming die as set forth in claim 6, wherein said first end portion of said spring member contacts said internal shoulder in said pilot aperture.

8. The metal forming die as set forth in claim 1, wherein said first shoulder on said pilot body is flush with a portion of the top surface of the die member.

9. A pilot assembly provided in a stock piece working area of a metal forming die in which a stock piece is formed into at least one part, comprising:

a pilot body having a first end portion, with a first diameter, oriented away from the stock piece working area and an oppositely disposed second end portion, with a second diameter, oriented toward the stock piece working area, said second diameter being larger than said first diameter to define a first shoulder therebetween, at least a portion of said shoulder being in contact with at least a portion of the upper surface of a first die member, including:

a tapered tip; and a retaining ring groove located on an exterior surface of said first end portion;

at least one ejector pin body, positioned adjacent to said pilot body, having a first end portion, with a first diameter oriented away from the stock piece working area, a second end portion with a second diameter oriented toward the stock piece working area, and a medial portion with a third diameter that is larger than said first diameter and said second diameter, disposed between said first end portion and said second end portion, including:

a first shoulder at the intersection of said first diameter and said third diameter;

a second shoulder at the intersection of said second diameter and said third diameter;

a spring member surrounding at least a portion of said first end portion of said ejector pin body, said spring member having a first end portion oriented away from the stock piece working area and a second end portion oriented toward the stock piece working area, at least a portion of said second end portion contacting at least a portion of said first shoulder on said ejector pin body;

a retaining ring coupled to said retaining ring groove in said pilot body, at least a portion of said retaining ring being in contact with at least a portion of the lower surface of said first die member; and wherein at least a portion of said second shoulder on said ejector pin body contacts at least a portion of said first shoulder on said pilot body to positively limit travel of said ejector pin body as said spring member expands.

10. The pilot assembly of claim 9, wherein said first end portion of said ejector pin body includes a wider section that is received within the interior of said spring member.

11. The pilot assembly of claim 9, including a pair of ejector pin bodies disposed on opposite sides of said pilot body.

12. The pilot assembly of claim 9, wherein said retaining ring is an E-style ring.

13. The pilot assembly of claim 9, wherein said pilot body is a single piece of metal.

14. The pilot assembly of claim 9, wherein said ejector pin body is a single piece of metal.

15. A pilot assembly positioned in a metal forming die with a stock piece working area configured to receive a stock piece, comprising:

a pilot body having a first end portion, having a first diameter, oriented away from the stock piece working area and an oppositely disposed second end portion, having a second diameter larger than the first diameter, oriented toward the stock piece working area, including:

a shoulder formed at the intersection of said first diameter and said second diameter, at least a portion of said shoulder being in contact with at least a portion of the upper surface of a first die member;

a tip including a terminal end portion configured to be smaller than a hole in the stock piece;

a retaining ring groove located on said first end portion;

at least one ejector pin body, positioned adjacent to said pilot body, having a first end portion oriented away from the stock piece working area with a first diameter, an oppositely disposed second end portion with a second diameter that is oriented toward the stock piece working area, and a medial portion with a third diameter that is larger than said first diameter and said second diameter, disposed between said first end portion and said second end portion, including:

a first shoulder at the intersection of the first diameter and the third diameter;

a second shoulder at the intersection of the second diameter and the third diameter;

a spring member surrounding at least a portion of said first end portion of said ejector pin body, said spring member having a first end portion oriented away from the stock piece working area and a second end portion oriented toward the stock piece working area, at least a portion of said second end portion contacting at least a portion of said first shoulder of said ejector pin body; and a retaining ring coupled to said retaining ring groove in said pilot body, at least a portion of said retaining ring being in contact with at least a portion of the lower surface of said first die member.

16. The pilot assembly of claim 15, wherein said second shoulder on said ejector pin body abuts said first shoulder on said pilot body to positively limit travel of the ejector pin body when said spring member expands.

17. The pilot assembly of claim 15, including a pair of ejector pin bodies.

18. The pilot assembly of claim 15, wherein said pilot body is a single piece.

19. The pilot assembly of claim 15, wherein said ejector pin body is a single piece.

20. The pilot assembly of claim 15, wherein said first end portion of said at least one ejector pin body includes a wider section.

* * * * *